US006167223A

United States Patent [19]

Fiore et al.

[11] Patent Number: 6,167,223

[45] Date of Patent: Dec. 26, 2000

[54] PHOTORECEPTOR DRIVE MODULE

[75] Inventors: Steven J. Fiore, North Hilton; Frank A. Porter, Penfield; Carmen J. Sofia, Rochester; Anthony G. Poletto, Fairport; Edward T. Hinton, Rochester, all of N.Y.

[73] Assignee: Xerox Corporation, Stamford, Conn.

[21] Appl. No.: 08/835,978

[22] Filed: Apr. 11, 1997

[51] Int. Cl.[7] ..... G03G 15/00

[52] U.S. Cl. ..... 399/165; 399/116; 399/162; 399/164

[58] Field of Search ..... 399/162, 164, 399/116, 165, 167

[56] References Cited

U.S. PATENT DOCUMENTS

| | | | |
|---|---|---|---|
| 3,836,245 | 9/1974 | Hastwell et al. | 399/164 |
| 4,009,958 | 3/1977 | Kurita et al. | 399/165 |
| 4,364,656 | 12/1982 | Yanagawa | 399/165 X |
| 4,415,263 | 11/1983 | Hoffman | 399/162 |
| 4,470,690 | 9/1984 | Hoffman | 399/164 |
| 4,563,077 | 1/1986 | Komada | 399/165 |
| 4,616,920 | 10/1986 | Itoigawa et al. | 399/116 |
| 4,626,095 | 12/1986 | Berger | 399/165 |
| 4,634,264 | 1/1987 | Takahashi | 399/116 |
| 4,804,993 | 2/1989 | Kenin et al. | 399/116 |
| 5,122,836 | 6/1992 | Fujiwara et al. | 399/116 |
| 5,170,209 | 12/1992 | Tompkins et al. | 399/107 |
| 5,400,121 | 3/1995 | Foote | 399/116 |
| 5,510,877 | 4/1996 | deJong et al. | 399/38 |
| 5,659,851 | 8/1997 | Moe et al. | 399/165 |
| 5,708,924 | 1/1998 | Shogren et al. | 399/116 |

*Primary Examiner*—Matthew S. Smith
*Attorney, Agent, or Firm*—Kevin R. Keprer

[57] ABSTRACT

A drive module for a photoreceptor in an electrophotographic printing machine. The drive module has retractable features that allow the insertion and removal of the xerographic CRU without causing damage to the photoreceptor and other critical subsystems. The unit further has many locating members for other subsystems so that critical tolerances are maintained. A single handle assembly retracts/unlocks and extends/locks the drive module and the associated CRU subsystems into an operative position. The drive module also has electrical and drive connections for the cleaning system, the charging system and transfer/detack.

12 Claims, 12 Drawing Sheets

PHOTORECEPTOR DRIVE MODULE

This invention relates generally to a drive module, and more particularly concerns a modular drive unit for an electrophotographic printing machine that utilizes various customer replaceable units for subsystem replacement.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

It is desirable to have a drive system which will cooperate with a CRU and allow easy removal and replacement of the various machine subsystems with little or no service technician intervention. It is also desireable that any such drive system maintain critical parameters with respect to clearance of the various systems and also be robust enough to maintain precise speed control.

In accordance with one aspect of the present invention, there is provided a drive module for an electrophotographic printing machine utilizing a customer replaceable unit (CRU) for xerographic components, comprising a support frame, a plurality of roll members mounted in said support frame, wherein at least one of said plurality of roll members is movable from a first position to a second position with respect to the remaining of said plurality of roll members, a drive unit mounted on said frame for imparting rotational motion to one of said plurality of roll members and an actuator for moving said movable one of said plurality of roll members axially with respect to said remaining of said plurality of roll members from the first position to the second position.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
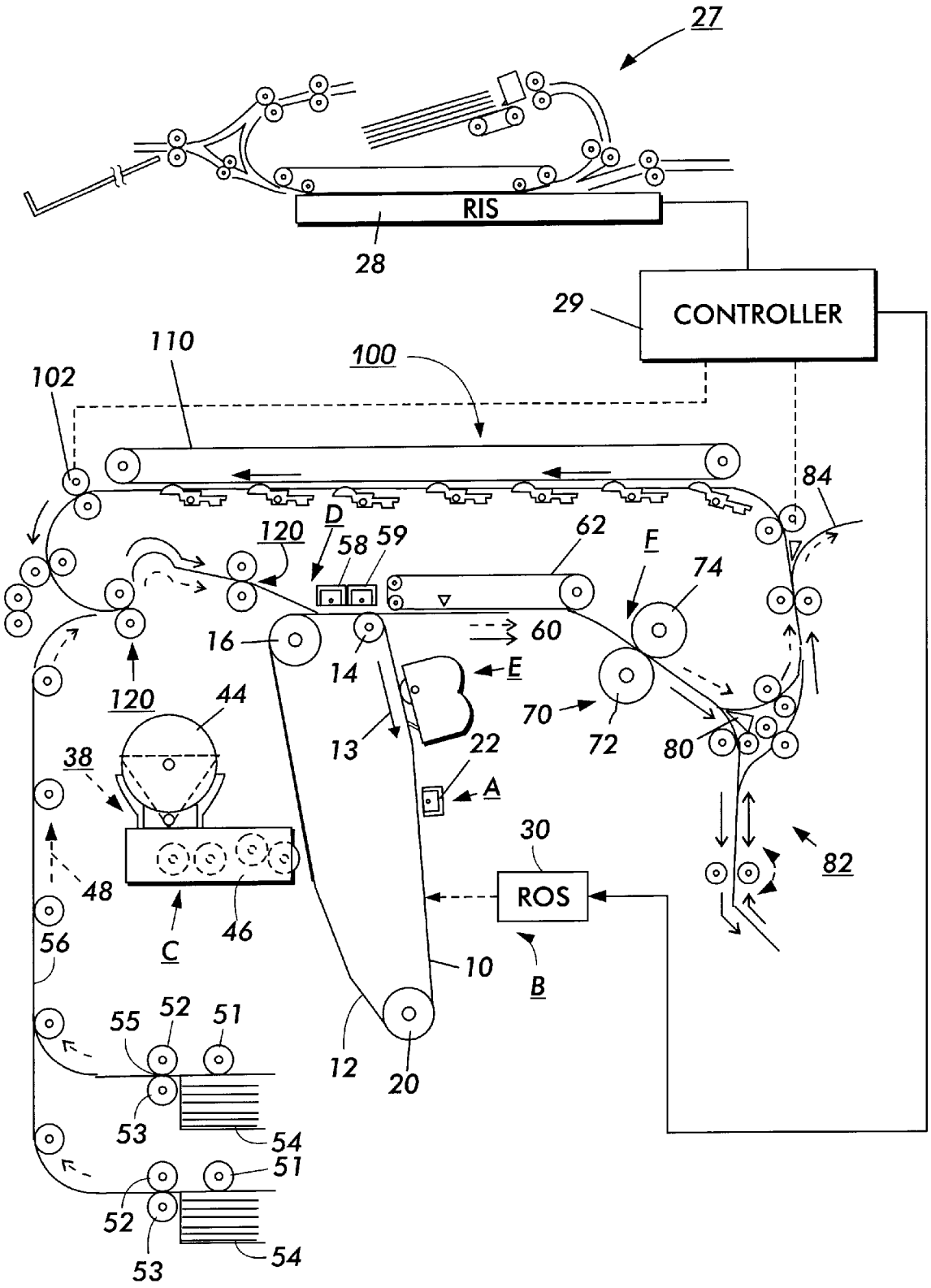
FIG. 1 is a schematic elevational view of a typical electrophotographic printing machine utilizing the photoreceptor drive module of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the photoreceptor drive module of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) 30 described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
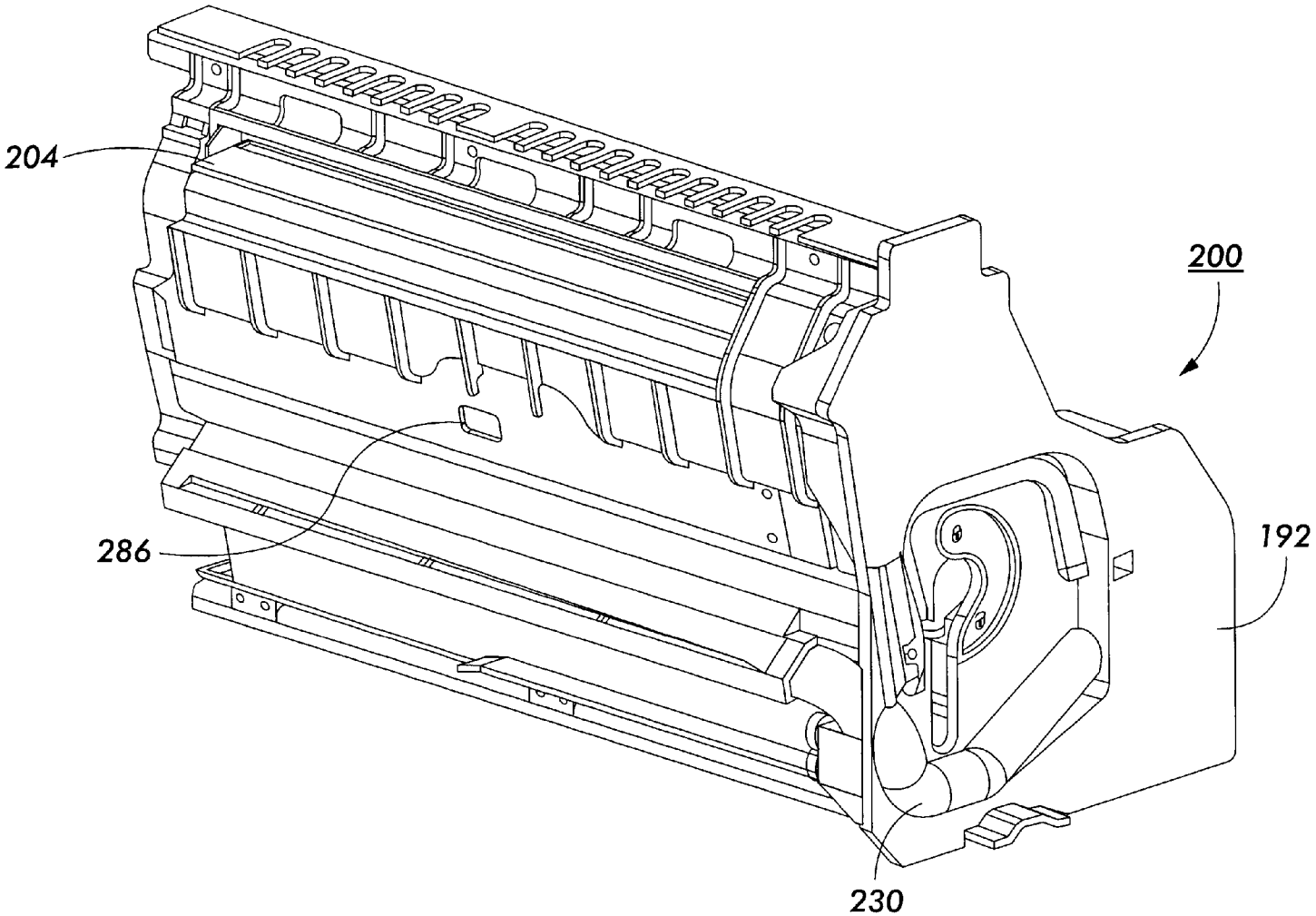
FIG. 2 is a perspective view of one side of a xerographic CRU.
Figure 3:
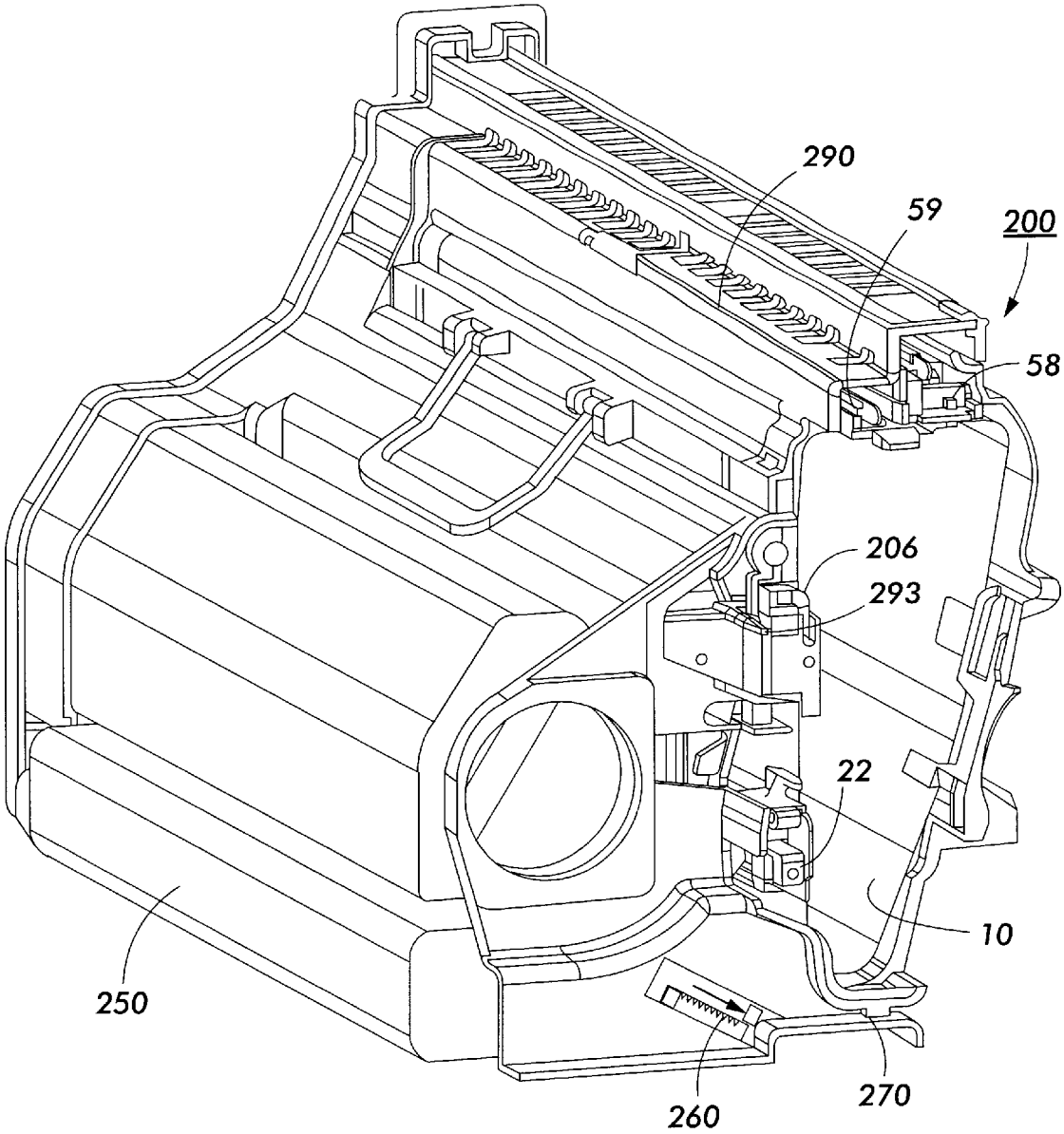
FIG. 3 is a perspective view of the opposite side of the FIG. 2 CRU.

Turning next to FIGS. 2 and 3, there is illustrated perspective views of the xerographic customer replaceable unit (CRU) 200. The xerographic CRU 200 module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor (P/R) belt 10, the noise, ozone, heat and dirt (NOHAD) handling manifolds 230 and filter 240, the waste bottle 250, the drawer connector 260, Customer Replaceable Unit Monitor CRUM 270, the automatic cleaner blade engagement/retraction and automatic waste door open/close device (not illustrated).

A summary of the xerographic CRU components and the function of each is as follows:

Cleaner 206 (Doctor blade and Disturber Brush): remove untransferred toner from the photoreceptor; transport waste toner and other debris to a waste bottle for storage; assist in controlling the buildup of paper talc, filming and comets on the photoreceptor belt.

Precharge Erase Lamp 210: provides front irradiation of the photoreceptor to the erase the electrostatic field on the surface.

Charge Pin Scorotron 22: provides a uniform charge level to the photoreceptor belt in preparation for imaging.

Photoreceptor Belt 10: charge retentive surface advances the latent image portions of the belt sequentially through various xerographic processing stations which converts electrostatic field on the surface.

Pretransfer Paper Baffles 204: directs and controls tangency point between the paper and photoreceptor surface. Creates an "S" bend in paper to flatten sheet in the transfer zone.

Transfer Wire Corotron 58: places a charge on the paper as in passes under the corotron. The high positive charge on the paper causes the negative charged toner to transfer from the photoreceptor to the paper.

Detack Pin Corotron 59: assist in removing paper with its image from the photoreceptor by neutralizing electrostatic fields which may hold a sheet of paper to photoreceptor 10. Sheet self strips as it passes over a stripper roll 14 on belt module 300.

NOHAD Dirt Manifolds 230 and Filter: removes airborne toner dirt and contaminates from the moving air before it leaves the CRU. The captured toner and contaminates are deposited in a dirt filter contained in the xerographic CRU.

Electrical Drawer Connector 260: provides connector interface for the CRUM; provides input/output for machine control.

CRUM Chip 270: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and Developer Interface: provides a developer interface window to allow transfer of toner for imaging from developer donor roll to P/R belt surface 12 latent image; Also, provides critical parameter mounting and location link which ties ROS 30 to P/R module 300 to ensure proper imaging and eliminate motion quality issues.

Black Toner Area Coverage BTAC Sensor Interface 286: provides interface window to monitor process controls.

Registration Transport Interface: provides outboard critical parameter location and mounting feature.

Prefuser Transport Interface: provides critical parameter location and mounting feature.

The CRU subsystems are contained within the xerographic housing. The housing consist of three main components which include the front end cap 192, right side housing 194 and left side housing 196. The xerographic housing 190 is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system with out damage or difficulty.

Figure 4:
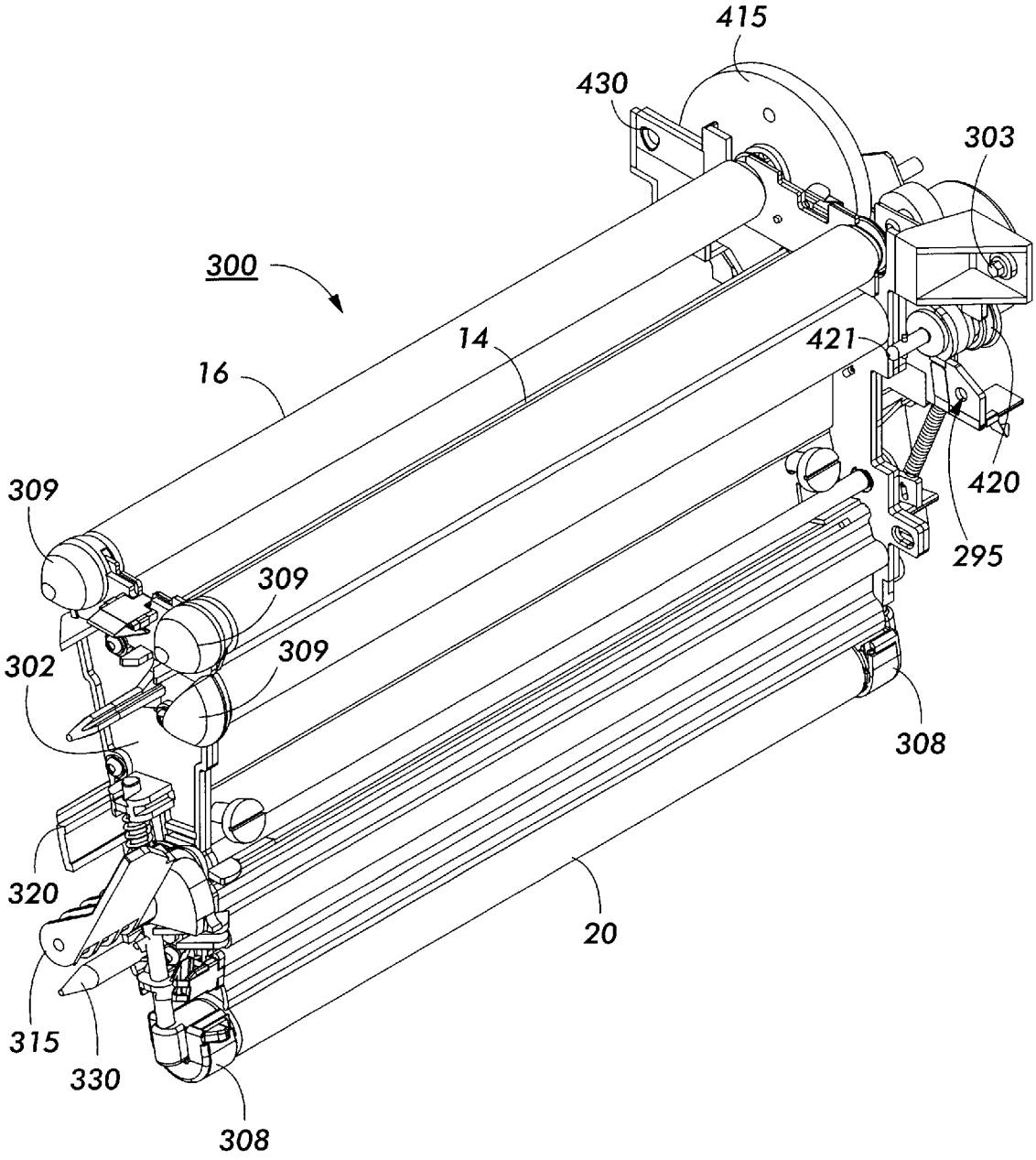
FIG. 4 is a perspective view of the photoreceptor belt drive module.
Figure 5:
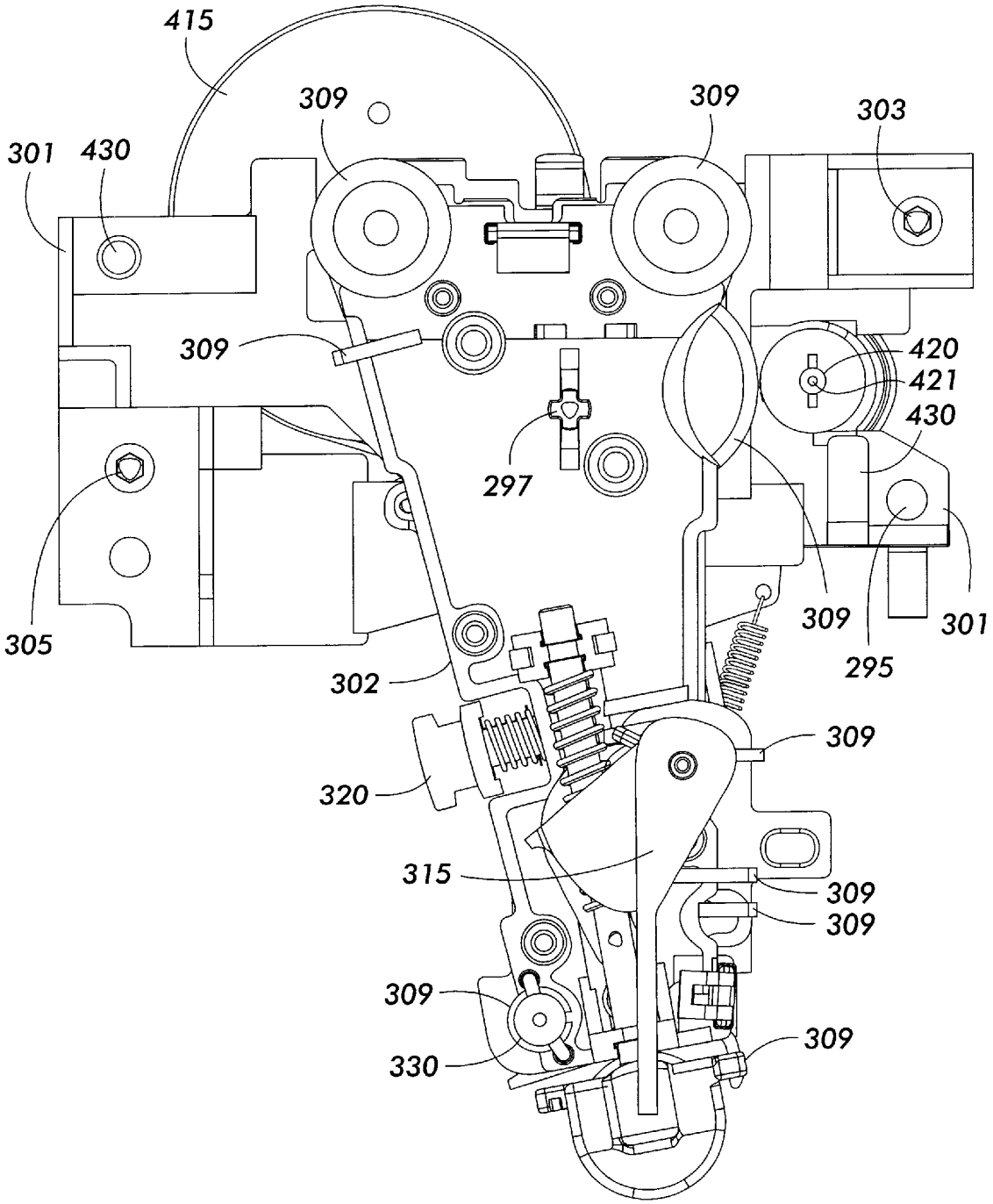
FIG. 5 is an end view of the FIG. 4 drive module.

Turning next to FIGS. 4 and 5 the P/R module 300 is shown, the module, generally referred to as reference numeral 300, must interface with several sub systems: xerographic charging, imaging, development, paper registration, transfer, cleaning, erase, the machine frames, and the xerographic CRU. The unit's primary function is to rotate the photoreceptor (P/R) belt 10 to the various xerographic sub systems in order to transfer a toner image from the belt to a sheet of paper.

The photoreceptor (P/R) module 300 is mounted to the machine frames on the machine frames backplate with two fasteners using mounting holes 303, 305. The imager backer bar 330 locates in a hole in the machine frames backplate. A second feature, to eliminate rotation, is on the P/R module rear plate 301. When mounted, the P/R module 300 is cantilevered off the machine frames backplate until the xerographic CRU 200 is inserted into position.

Figure 11:
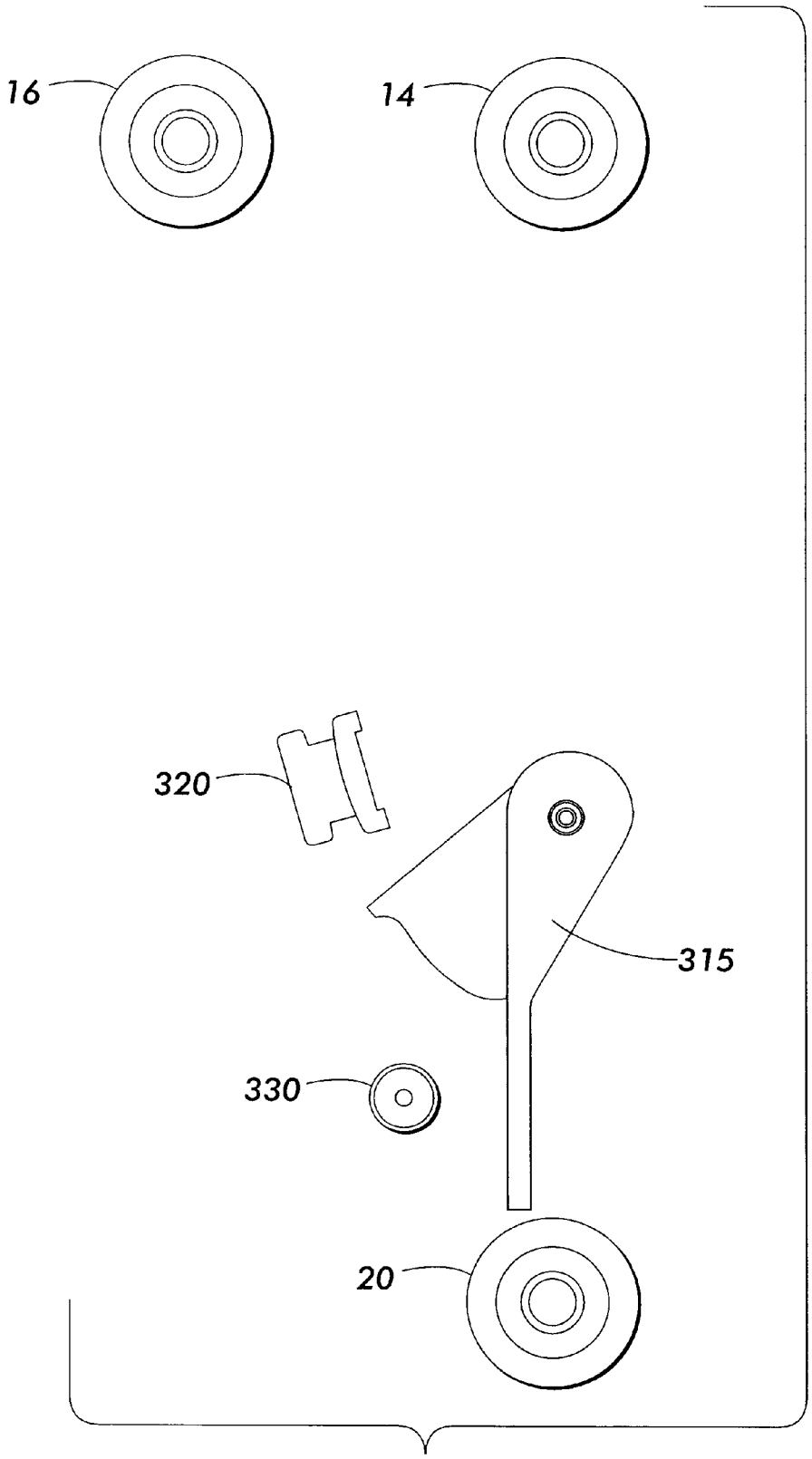
FIGS. 11 and 12 illustrate the operation of the interlock handle relative to the moving roll and backer member of the invention herein.
Figure 12:
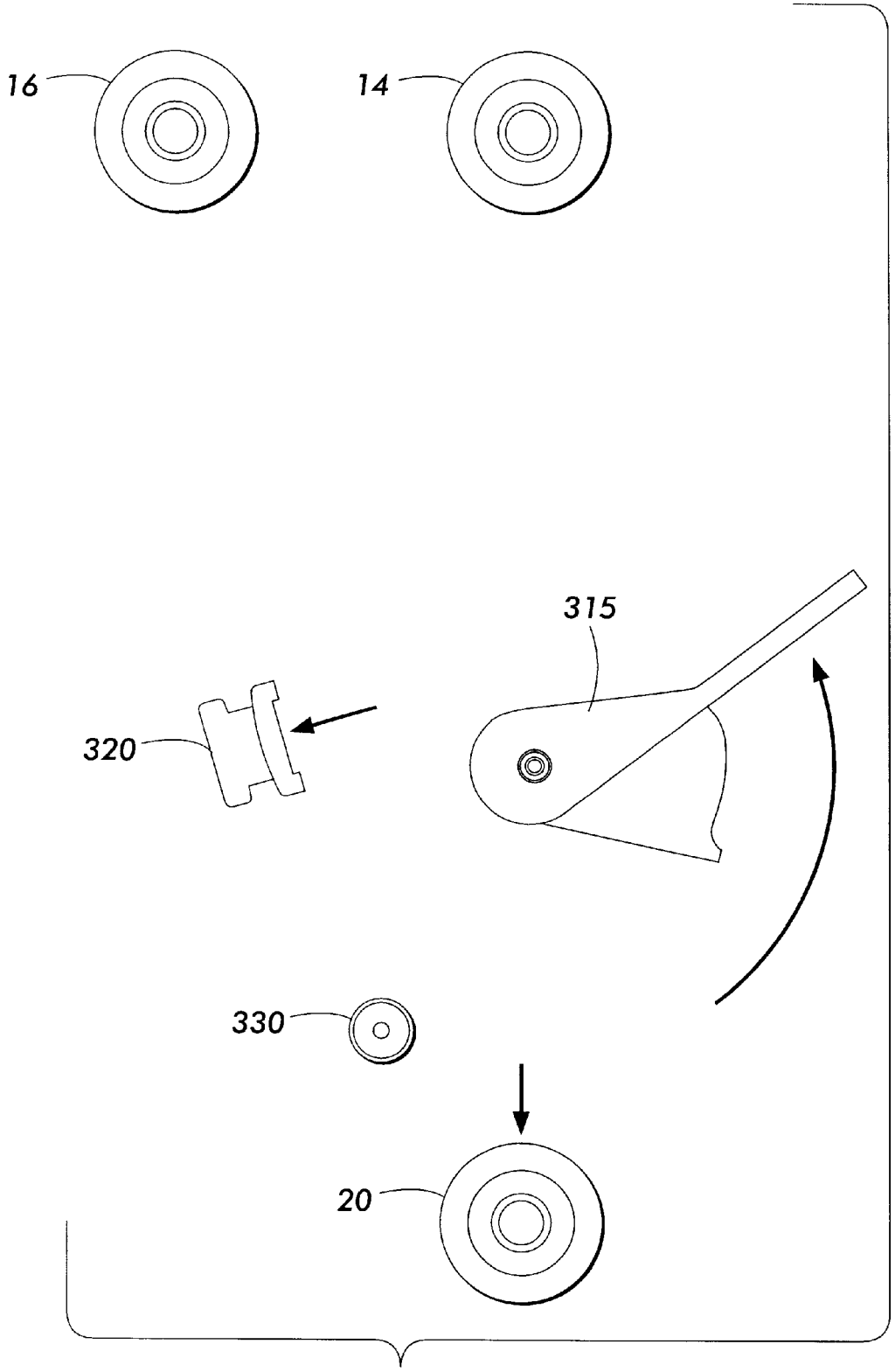

By rotating the P/R module handle 315 clockwise to a substantially vertical position, the tension roll 20 and developer backer bar 320 are contracted, allowing the user to insert/remove the xerographic CRU 200 without interference or damage to components. After the xerographic CRU 200 is fully inserted, the user rotates the handle 315 counter clockwise approximately 150° to return the tension roll 20 and developer backer bar 320 to their operating positions with the handle operating as an interlock to prevent removal of the CRU 200 while the tension roll 20 and backer bar 320 are extended as illustrated in FIGS. 11 and 12.

The xerographic CRU 200 locates to the P/R module 300 in the rear with a hole/pin 295, 293 interface between the xerographic CRU 200 and the rear plate 301 of the P/R module 300. The front interface is also accomplished this way, however the pin 297 on the front plate 302 of the P/R module 300 and the image backer bar 330 on the P/R module 300 are supported by the xerographic CRU 200. The front plate of the P/R module 302, along with the P/R module handle 315 and the P/R module edge guides 308 have features 309 to guide the P/R belt 10 over the front of the P/R module 300 assembly eliminate P/R belt damage due to insertion to the xerographic CRU 200.

Figure 6:
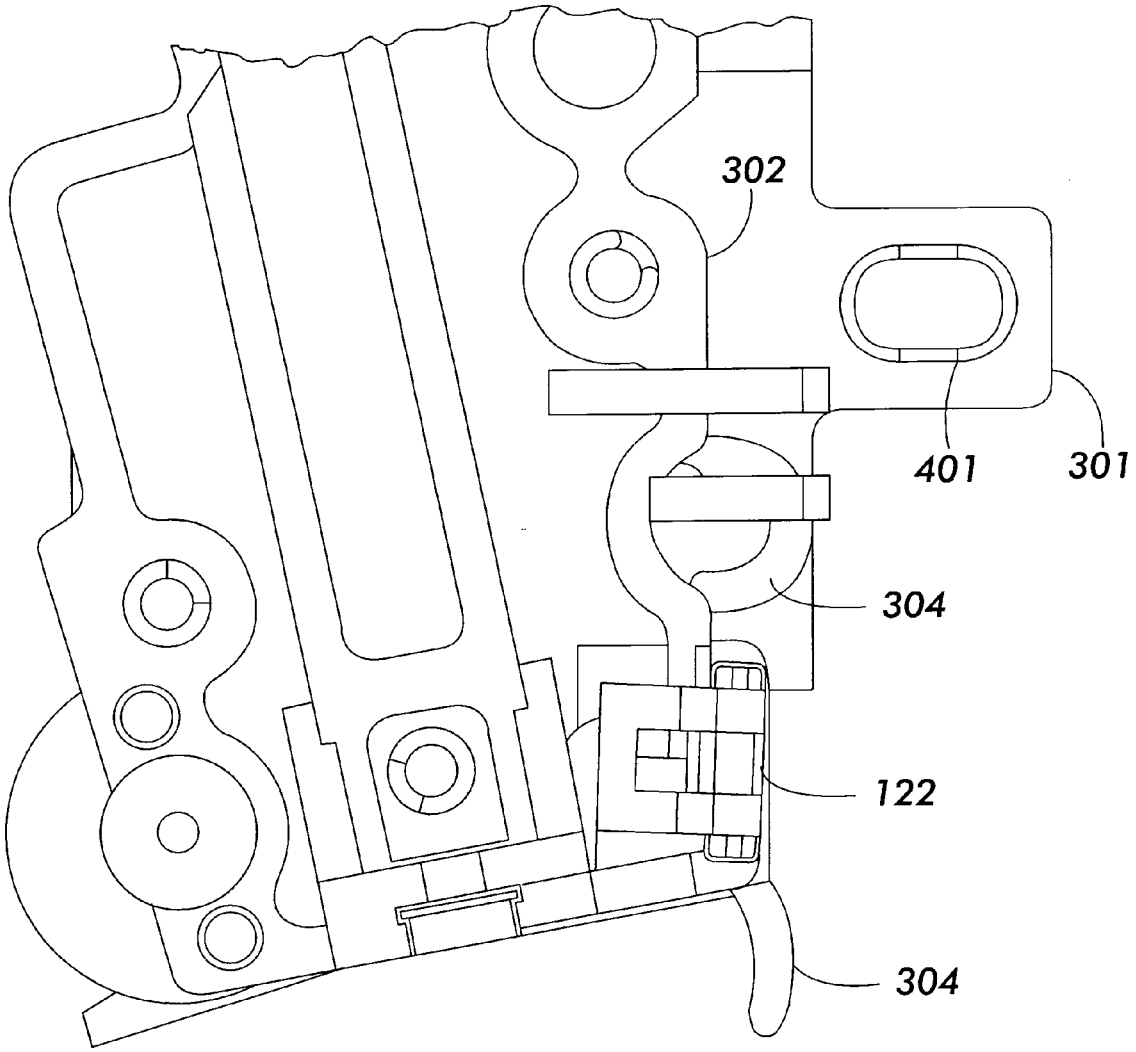
FIG. 6 is a partial end view illustrating the charging system interface.

As shown in the partial end view of the front plate/extrusion in FIG. 6, the charge scorotron is forced against the P/R module extrusion 304 which forms the center section of the module between the front plate 302 and rear plate 301 with the use of springs 122, 123, a front spring 122 mounted to the front plate 302 of the P/R module 300 and one spring 123 in the rear mounted to the charge scorotron 22 itself. The interface gap required between these two devices is maintained by four pads (not shown) on the charge scorotron 22, the width of the front charge spring 122, and a hole 401/pin interface between the charge scorotron 22 and the rear plate 301 of the P/R module 300.

A link or plate is mounted to the rear part of the P/R module imager backer bar 330 to locate and support the imager subsystem (ROS) 30. The front support for the ROS is in the xerographic CRU. A plastic link in the xerographic CRU locates to the front part of the P/R module imager backer bar 330. This link then aligns the front of the ROS 30 to the P/R module backer bar 330.

Figure 10:
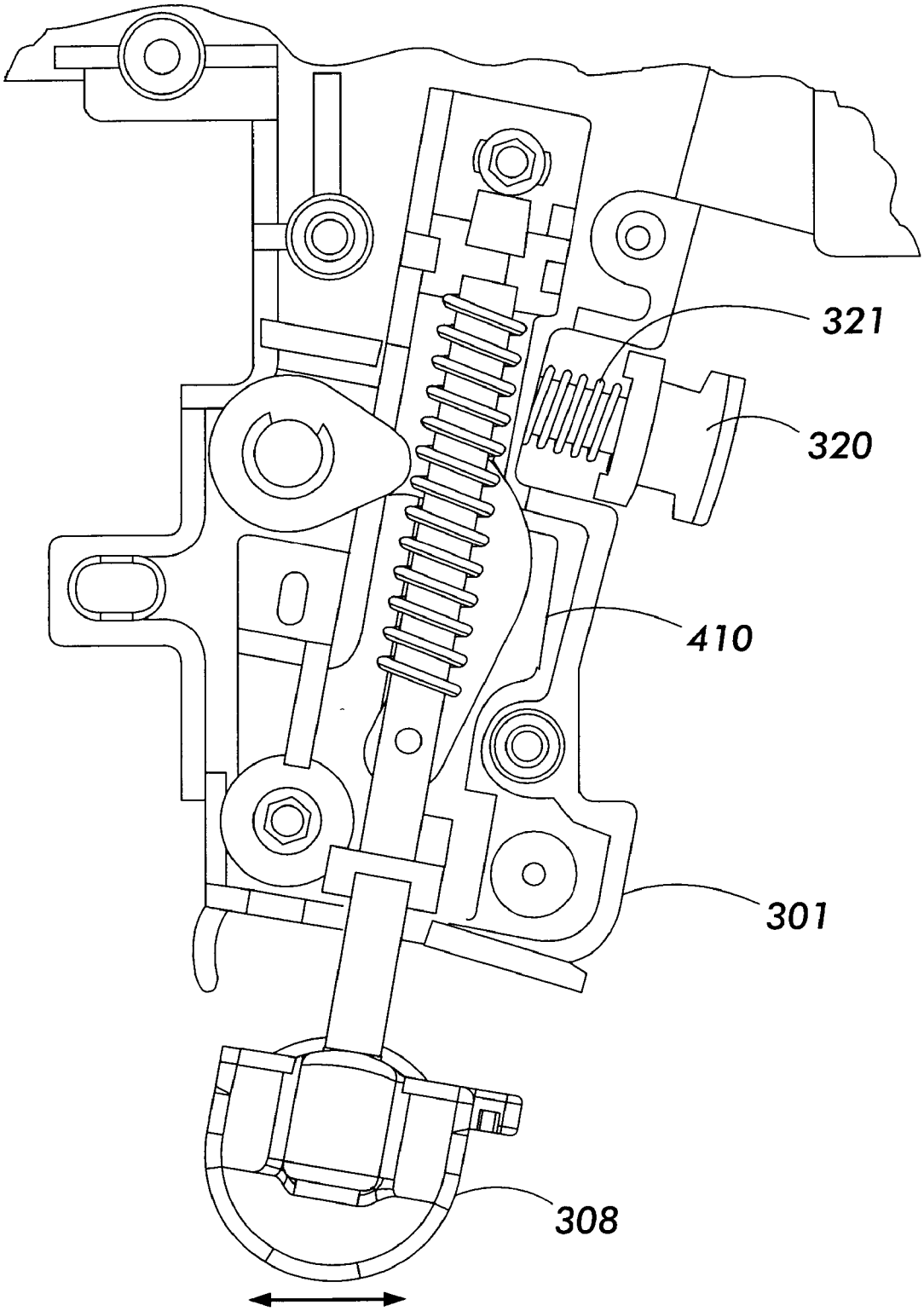
FIG. 10 is a partial rear end view illustrating the tension roll adjuster and the developer backer bar mechanism.

The developer backer bar is 320 forced against locators on the developer with two compression springs 321 (FIG. 10). The developer backer bar 320 is retracted away from the developer prior to xerographic CRU insertion/removal.

The paper registration transport subsystem is aligned to the P/R module via a hole 430/pin interface (FIG. 5) between the two sub systems in the rear of the machine. The front of the registration transport is located in the xerographic CRU.

Figure 7:
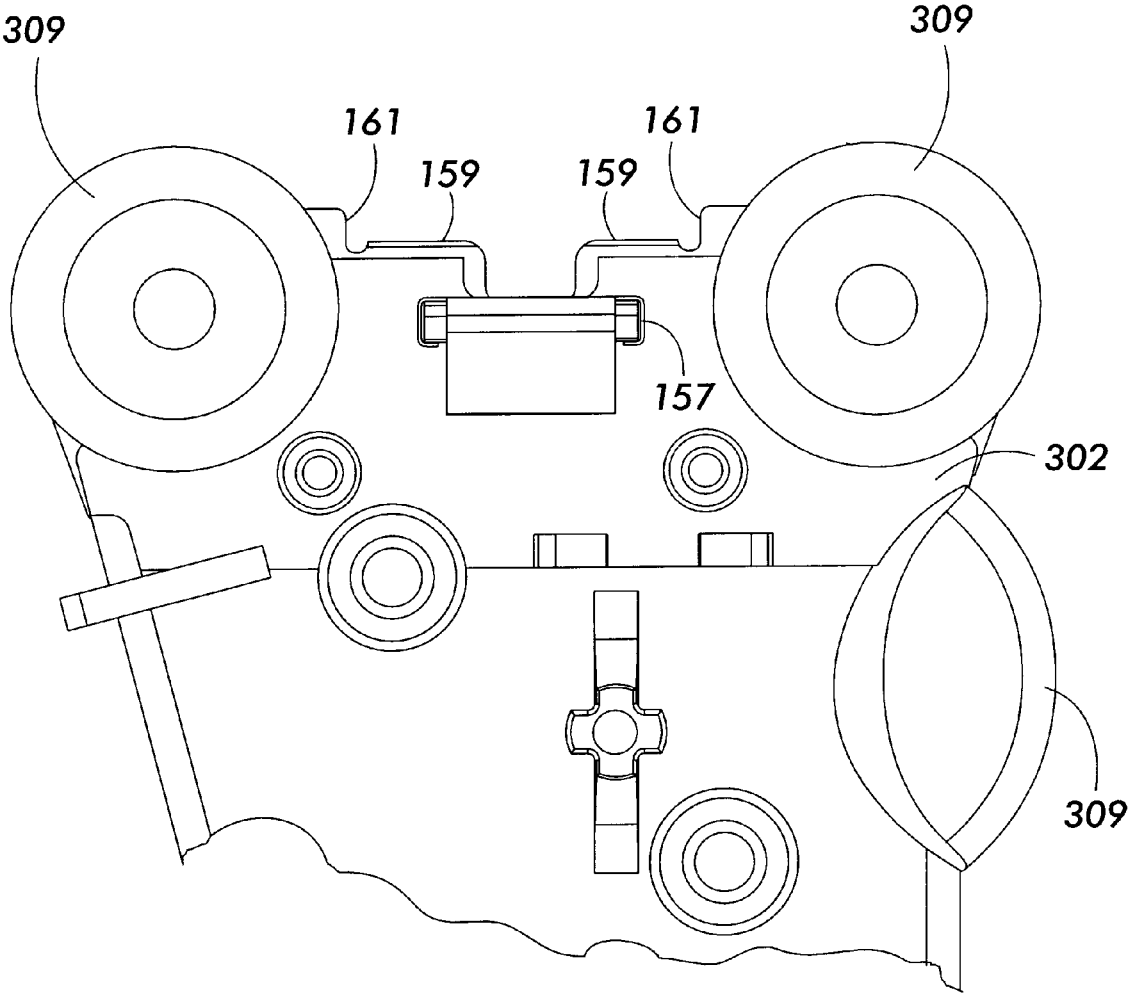
FIG. 7 is a partial front end view illustrating the transfer/detack system interface.
Figure 8:
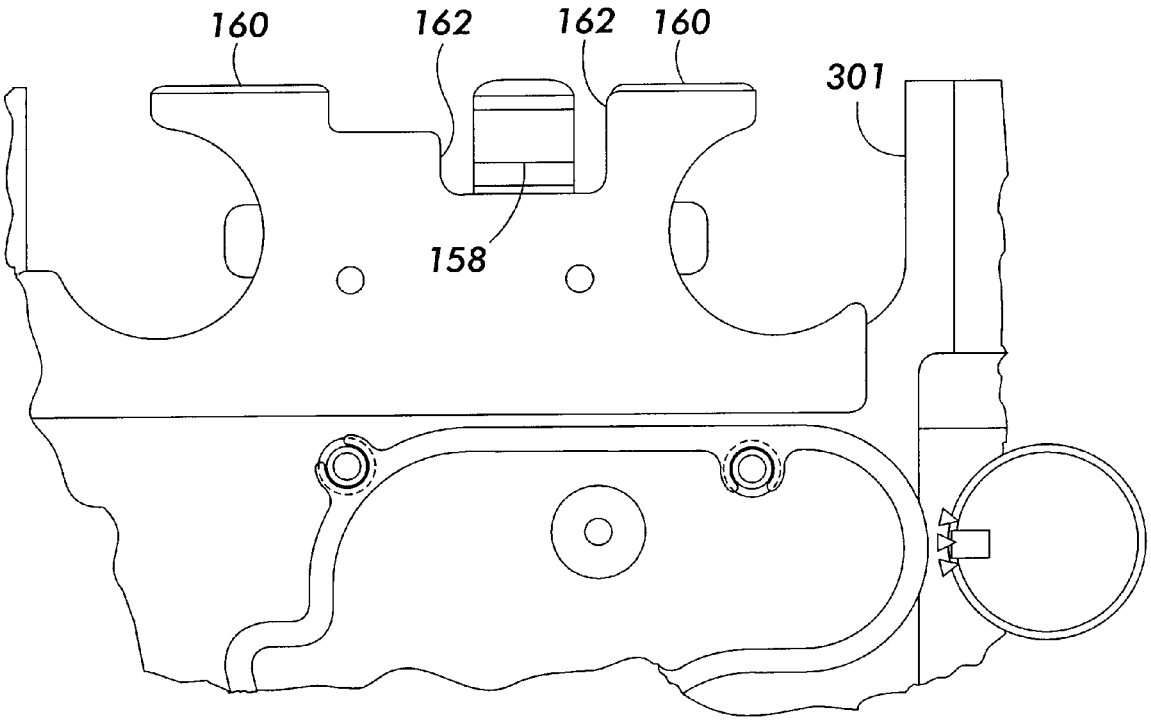
FIG. 8 is a partial rear end view illustrating the transfer/detack system interface.

As shown in the partial views of FIGS. 7 and 8, the transfer/detack 58, 59 corotron is located in the xerographic CRU. The interface to the P/R module is accomplished in the front and rear the same way. On the P/R module front and rear plates are mounted two sheetmetal roll mounting plates, each with pads located to the centerlines of the P/R module drive 16 and stripper 14 rolls to position the height of the transfer/detack corotron 58, 59. Each plate also has a feature 161, 162 that locates the transfer/detack corotron from left to right. There are two springs, one in the front 157 and one in the rear 158 of the P/R module that force the transfer/detack corotron 58, 59 against the pads 159, 160 of the two sheetmetal plates.

Mounted to the P/R module rear plate is the cleaner drive pulley assembly 420. This pulley assembly 420 is driven by the P/R module drive roll assembly 415 via a rubber belt (not shown) and a tensioning idler (not shown), which is driven by the P/R module drive motor (not shown). The cleaner brush, which is located in the xerographic CRU, mates with the shaft 421 on the cleaner drive pulley assembly 420. Mounted near the cleaner drive pulley assembly is the flicker bar ground spring 440 which interfaces with the cleaner flicker bar allowing a static ground path to the machine frames backplate 301.

Figure 9:
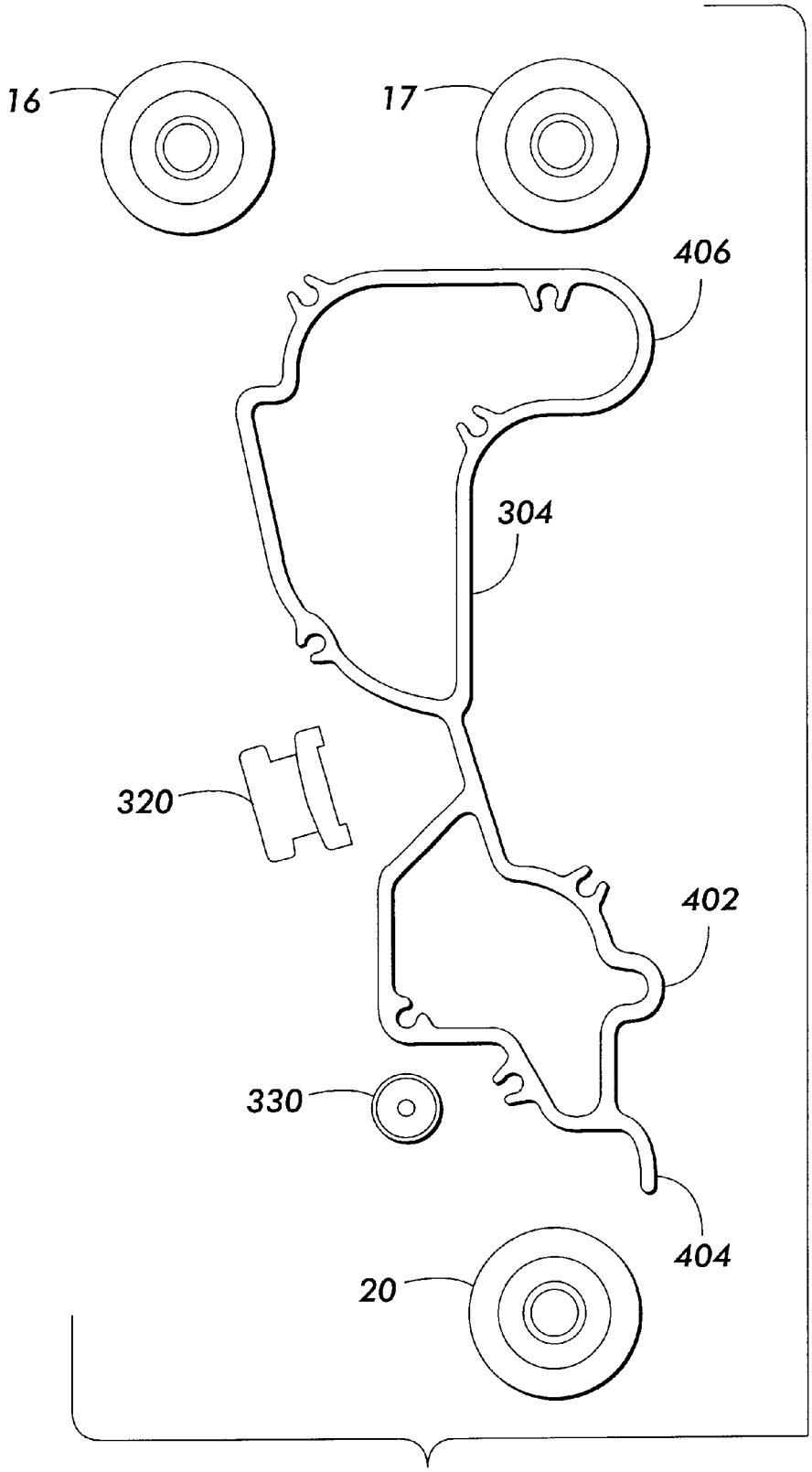
FIG. 9 is a schematic end view illustrating the module extrusion and the integrated backer members.

The P/R belt 10 is rotated through these various interfaces by three low lateral force (LLF) rolls 14, 16, 20: the drive roll 16, stripper roll 14, and tension roll 20. In order to maintain the interface gaps between the various sub systems and the P/R belt 10, stationary backers are located at or near the required zones: charge 402, 404 (2 backers, part of P/R module extrusion 304), imaging 330 (1 backer bar), develop 320 (1 backer bar), and cleaning 406 (1 backer bar, part of P/R module extrusion 304) as shown schematically in FIG. 9.

FIG. 10 is a partial view of the rear plate of the P/R module. The lateral movement of the P/R belt is limited by the use of 2 edge guides 308, one on either end of the tension roll 20. An alignment of 0.5 mm between the three LLF rolls is required to maintain a low force on the P/R belt edge so the edge does not become damaged. This is accomplished by first aligning each sheetmetal roll mounting plate to the corresponding plastic side plate. These sub assemblies are then aligned to one another in a fixture and are mounted to the P/R module extrusion 304. After the drive roll 16 and stripper roll 14 are mounted to this sub assembly, the tension roll 20 is aligned to the drive roll 16 in a fixture and securely mounted in place. The tension roll adjuster 410 allows the module to be aligned before it is mounted in a machine yet still allows the tension roll 20 to be retracted for xerographic CRU insertion/removal but maintains the alignment when the tension roll 20 is extended.

While the invention herein has been described in the context of a modular photoreceptor drive unit for a black and white printing machine, it will be readily apparent that the device can be utilized in any printing machine utilizing a modular xerographic CRU.

In recapitulation, there is provided a drive module for a photoreceptor in an electrophotographic printing machine. The drive module has retractable features that allow the insertion and removal of the xerographic CRU without causing damage to the photoreceptor and other critical subsystems. The unit further has many locating members for other subsystems so that critical tolerances are maintained. A single handle assembly retracts/unlocks and extends/locks the drive module and the associated CRU subsystems into an operative position. The drive module also has electrical and drive connections for the cleaning system, the charging system and transfer/detack.

It is, therefore, apparent that there has been provided in accordance with the present invention, a photoreceptor drive module that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A drive module for an electrophotographic printing machine utilizing a customer replaceable unit (CRU) for xerographic components, comprising:

a support frame;

a plurality of roll members mounted in said support frame, wherein at least one of said plurality of roll members is movable from a first position to a second position with respect to the remaining of said plurality of roll members;

a drive unit mounted on said frame for imparting rotational motion to one of said plurality of roll members; and an actuator for moving said movable one of said plurality of roll members radially with respect to said remaining of said plurality of roll members from the first position to the second position to cooperate with the CRU.

2. A drive module for an electrophotographic printing machine utilizing a customer replaceable unit (CRU) for xerographic components, comprising:

a support frame;

a plurality of roll members mounted in said support frame, wherein at least one of said plurality of roll members is movable from a first position to a second position with respect to the remaining of said plurality of roll members;

a drive unit mounted on said frame for imparting rotational motion to one of said plurality of roll members;

an actuator for moving said movable one of said plurality of roll members radially with respect to said remaining of said plurality of roll members from the first position to the second position to cooperate with the CRU, and a backer member mounted in said support frame, said backer member being movable with respect to said support frame so as to contact a photoreceptive member portion of the CRU when in a first position and to retract from contact with the photoreceptive member when in a second position.

3. A drive module according to claim 2 wherein said backer member and said movable roll member are moved in unison by said actuator.

4. A drive module according to claim 2, further comprising a plurality of guide members located on a front surface of said drive module so that the xerographic CRU is moved into position without damage to said xerographic CRU.

5. A drive module according to claim 2, further comprising a plurality of locating surfaces for a plurality of xerographic components.

6. A drive module according to claim 2, wherein said actuator comprises:

a handle movable from a first position to a second position;

a first biasing member to impart a force on said moveable roll member;

a second biasing member to impart a force on said backer member, wherein said first and second biasing members are released when said handle is moved from a first position to a second position and said biasing members are constrained when said handle is moved in from said second position to said first position.

7. A drive module according to claim 6, further comprising an interlock mechanism wherein movement of said handle from the first position to the second position further locks the xerographic CRU into position.

8. A drive module according to claim 2, wherein said support frame further comprises a plurality of fixed backer members for locating and supporting a plurality of xerographic components.

9. A drive module according to claim 2, further comprising a secondary drive unit, said secondary drive unit cooperating with said xerographic CRU to move a component thereof.

10. A drive module according to claim 9, wherein said secondary drive unit is a cleaner drive.

11. A drive module according to claim 2, further comprising an adjuster mechanism to align said plurality of roll members axially parallel within said support frame.

12. A drive module according to claim 2, wherein said plurality of roll members comprise:

a drive roll connected to said drive unit;

a stripper roll;

a tensioning roll, wherein said tensioning roll is radially movable with respect to said drive roll and said stripper roll.

* * * * *